US005096386A

United States Patent [19]

Kassel

[11] Patent Number: 5,096,386

[45] Date of Patent: Mar. 17, 1992

[54] INTEGRAL LIQUID RING AND REGENERATIVE PUMP

[75] Inventor: John M. Kassel, Roscoe, Ill.

[73] Assignee: Sundstrand Corporation, Rockford, Ill.

[21] Appl. No.: 437,677

[22] Filed: Nov. 17, 1989

[51] Int. Cl.[5] ..... F04C 19/00; F01D 1/12

[52] U.S. Cl. ..... 417/69; 415/55.4

[58] Field of Search ..... 417/68, 69; 415/55.5, 415/55.6, 55.7, 55.1-55.4

[56] References Cited

U.S. PATENT DOCUMENTS

| | | | |
|---|---|---|---|
| 3,031,974 | 5/1962 | Edwards . | |
| 3,045,602 | 7/1962 | Adams . | |
| 3,107,626 | 10/1963 | Thoren et al. . | |
| 3,213,794 | 10/1965 | Adams | 417/69 |
| 3,221,659 | 12/1965 | Adams | 417/69 |
| 3,518,028 | 6/1970 | Minick | 417/69 |
| 3,614,256 | 10/1971 | Sleghartner | 415/143 |
| 3,759,626 | 9/1973 | Becker | 415/90 |
| 3,771,898 | 11/1973 | Segebrecht | 415/53 |
| 3,788,766 | 1/1974 | Engels | 415/55.7 |
| 3,915,589 | 10/1975 | Vander Linden | 415/55.6 |
| 4,204,800 | 5/1980 | Bentele et al. . | |
| 4,273,515 | 6/1981 | Fitch | 417/62 |
| 4,363,598 | 12/1982 | Schonwald et al. . | |
| 4,479,756 | 10/1984 | Sleghartner . | |

*Primary Examiner*—Leonard E. Smith

*Assistant Examiner*—John A. Savio, III

*Attorney, Agent, or Firm*—Wood, Phillips, Mason, Recktenwald & Van Santen

[57] ABSTRACT

The problem of space and weight limitations for liquid ring pumps and regenerative pumps in aerospace applications is solved by a pump having a housing defining a first chamber (22) and a second chamber (24) independent of the first chamber. An impeller (10) is rotatably mounted in the housing and includes impeller blades (16) successively movable through the first chamber for cooperation therewith to provide a liquid ring portion of the pump, and through the second chamber for cooperation therewith to provide a regenerative portion of the pump. An inlet (26) admits fluid to the first chamber. A first outlet (28) from the first chamber feeds the fluid to an inlet (32) of the second chamber for pressurization therein. An outlet (34) from the second chamber feeds the pressurized fluid for appropriate use, such as in a fuel pump system. A dual pump configuration also is contemplated with a pair of first chambers (**22, 22*a*) and liquid ring portions of the pump, and a pair of second chambers (24, 24*a***) and regenerative portions of the pump. The fluid in the dual ring pump portions is fed to one of the liquid compressor portions and then to the other regenerative pump portion for doubling the effectiveness of the pump. All of this is accomplished by a unitary housing and a single impeller.

23 Claims, 1 Drawing Sheet

INTEGRAL LIQUID RING AND REGENERATIVE PUMP

FIELD OF THE INVENTION

This invention generally relates to fluid pumps and, particularly, to an integral impeller-type pump which combines a liquid ring pump and a regenerative pump in a unitary construction employing a single impeller.

BACKGROUND OF THE INVENTION

Historically, aircraft engine main fuel pumps primarily have been positive displacement type pumps, usually gear pumps which are relatively heavy devices In aerospace applications, space and weight limitations are constant and perplexing problems. Consequently, centrifugal pump concepts have been pursued for main fuel pump applications because of benefits obtained in weight and reliability. However, two performance criteria which make it difficult to adapt centrifugal pumps to the engine main fuel pump application are dry lift and engine starting pressure requirements. Dry lift is the ability of a pump to draw fuel up a dry length of plumbing, thereby priming itself Engine starting pressure is the ability of the pump to generate enough pressure to start the engine while operating at the low speeds associated with engine start. One way to supplement a centrifugal pump's deficiencies at dry lift is to add a liquid ring pump in series with the main centrifugal stage. Liquid ring pumps have good lift performance capabilities. To supplement the centrifugal pump's inability to generate sufficient engine start pressures at low starting speeds, one could add a regenerative pump in series with the liquid ring and centrifugal main stages. The result is a three stage pump with three separate pumping elements, three different containment structures and three different sets of associated porting.

This invention contemplates an integral liquid ring and regenerative pump combining liquid ring and regenerative pumps into a single stage, thereby simplifying the design by reducing piece part count. This reduced piece part count has advantages in weight, envelope and reliability.

SUMMARY OF THE INVENTION

An object, therefore, of the invention is to provide a new and improved pump employing a unitary construction for performing dual functions, as described.

In the exemplary embodiment of the invention, generally, the pump includes housing means defining first chamber means and second chamber means independent of the first chamber means. Impeller means are rotatably mounted in the housing means, with at least one impeller blade successively movable through the first chamber means for cooperation therewith to provide a liquid ring portion of the pump, and through the second chamber means for cooperation therewith to provide a liquid regenerative portion of the pump. Inlet means are provided to the first chamber means. First outlet means are provided from the first chamber means and for feeding a liquid to the second chamber means for pressurizing therein. Second outlet means are provided from the second chamber means from which pressurized liquid can be fed for appropriate use, such as in a fuel pump system.

In an aircraft engine main fuel pump application, the liquid ring pump could evacuate the fuel system inlet line of pressure, crating a vacuum that draws fuel up the inlet line thereby priming the fuel system pumping elements, including the regenerative pump. Once primed, the regenerative pump then would boost the system pressure to an appropriate level for engine start. Once the engine is started, a main pumping element would take over the fuel system pumping requirements.

As disclosed herein, the aforesaid inlet and outlet means are provided in a unitary housing for the pump. The first chamber means is located within a given portion of the housing means relative to rotation of the impeller means, and the second chamber means is located diametrically opposite the first chamber means.

In terms of a plane of rotation of the impeller blade, preferably, the first chamber means is located in the housing radially beyond the periphery of the impeller blade The second chamber means is located at one side of the impeller blade and extending around that side beyond the radial periphery of the impeller blade in the preferred embodiment. However, the second chamber means need not extend radially beyond the periphery of the impeller blade.

The invention further contemplates a pair of the first chamber means separated from each other on opposite sides of the impeller means, each having outlet means communicating with the second chamber means, still using a unitary housing and a single impeller. A pair of the second chamber means are provided on opposite sides of the impeller means, with the outlet means of the pair of first chamber means communicating with one of the pair of second chamber means, and an outlet from one of the pair of second chamber means communicating with an inlet to the other of the pair of second chamber means. This provides a dual pump to further reduce its size while still performing the two functions of a liquid ring pump and a regenerative pump. It is possible to reverse the liquid ring and regenerative pump positions relative to each other on either side of the impeller means such that one of the regenerative pumps is in the first chamber means and the respective liquid ring pump is in the second chamber means. It also is possible to locate both liquid ring pump chambers on one side of the impeller means and the regenerative pump chambers on the other side, of course with corresponding changes in the conduits or "piping" in the housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 2:
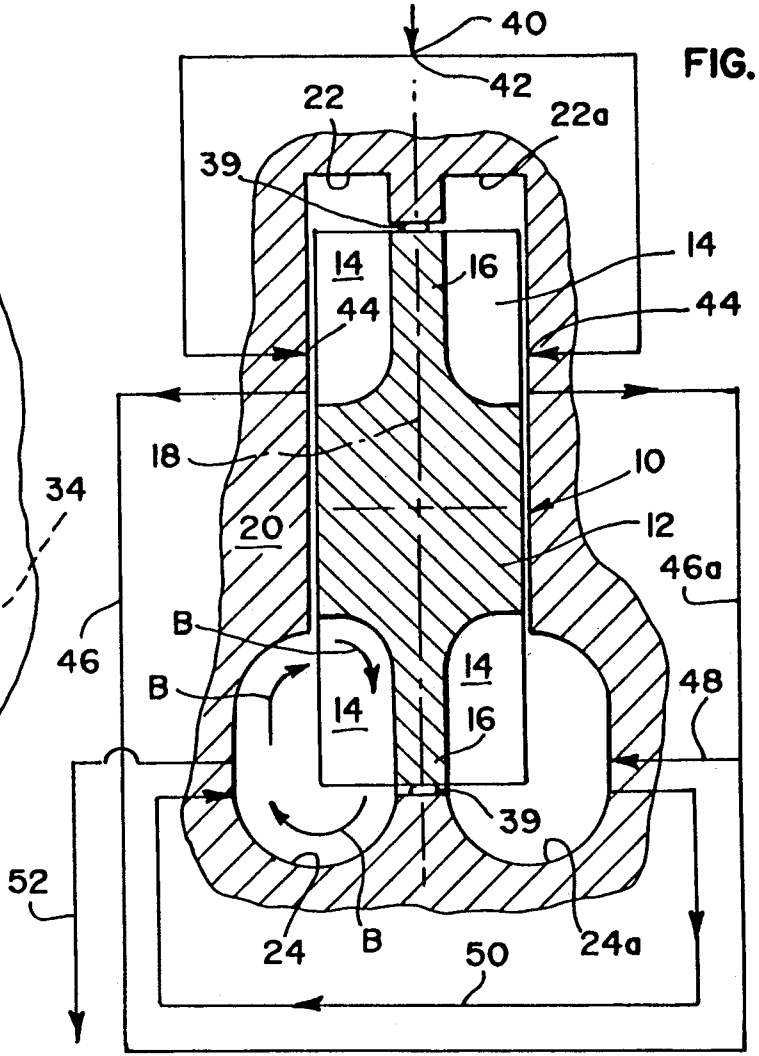
FIG. 2 is a fragmented vertical section taken generally along line 2—2 of FIG. 1, with the fluid and liquid flow circuit shown somewhat schematically.

Referring to the drawings in greater detail, the pump of this invention includes an impeller means, generally designated 10, in the form of a single impeller member having a hub 12 and a plurality of radially projecting impeller blades 14 joined by a web 16. It immediately should be understood that, as best illustrated in FIG. 2, the pump is shown as a dual-pump having respective liquid ring pump portions and regenerative pump portions of substantially identical configuration on opposite sides of a centerline 18 passing radially and centrally through impeller 10. The immediately following description will explain only one side of the pump, first, and then the entire dual construction and function of the pump will be described.

With that understanding, the drawings show the liquid ring portion of the pump in the upper half of the illustration and the regenerative portion of the pump in the lower half of the illustration. A unitary housing 20 surrounds impeller 10 and defines a first chamber 22 in the upper or liquid ring portion of the pump and a second chamber 24 in the lower or regenerative portion of the pump. It can be seen that first chamber 22 is located radially beyond the periphery of impeller blades 14. It also can be seen that, in terms of a plane of rotation of the impeller blades, second chamber 24 is located to one side of the impeller blades, within housing 20, and extending around that side beyond the radial periphery of the impeller blades. With this construction, the impeller blades successively move through first chamber 22 for cooperation therewith to provide a liquid ring portion of the pump and through second chamber 24 for cooperation therewith to provide a regenerative portion of the pump, as indicated by arrow "A" in FIG. 1. Of course, as with any such centrifugal pump, the spacing between the impeller blades actually become part of the pumping chamber cooperating with the actual chambers 22,24 cut into the housing. It also can be seen in FIG. 1 that liquid ring pump chamber 22 increases in diameter and then decreases in diameter within housing 20 between opposite angular ends of the housing area of the chamber.

Figure 1:
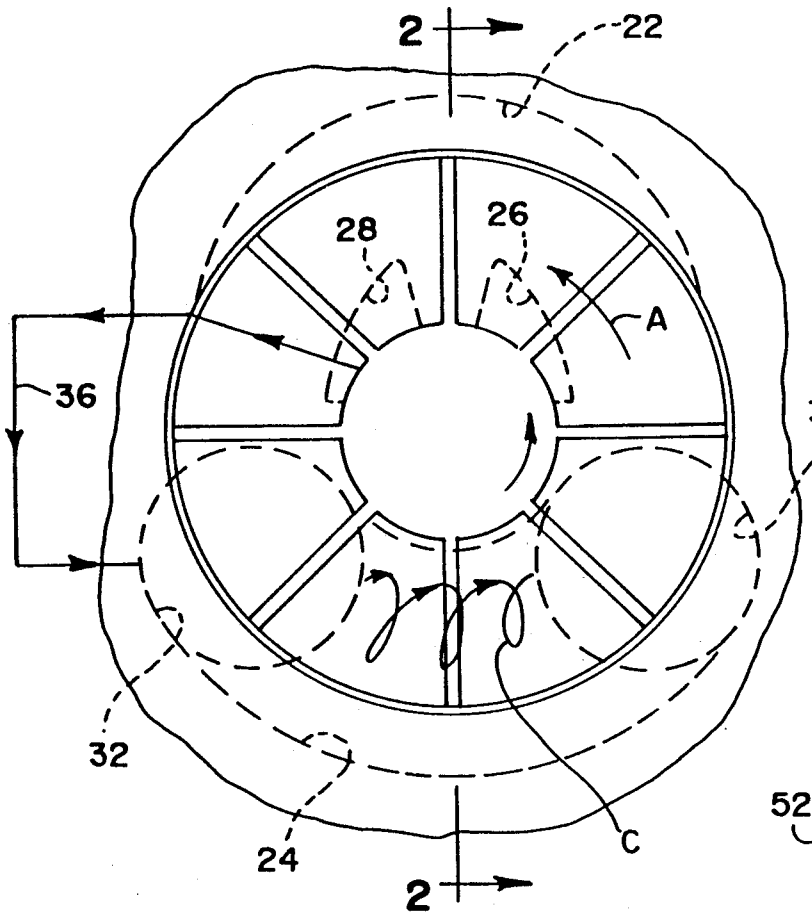
FIG. 1 is an axial end elevational view of the impeller means of the invention in conjunction, with the surrounding housing portions in section.

As shown by dotted lines in FIG. 1, an inlet port 26 appropriately is provided through housing 20 to the liquid ring portion of the pump, i.e. to the chamber means defined by the spacing between the impeller blades and the first chamber 22 in the housing In an aircraft engine main fuel pump application, this inlet is connected to the fuel system inlet line so that the liquid ring portion of the pump can evacuate the line of pressure by creating a vacuum strong enough to draw fuel up the line to thereby prime the fuel system pumping elements An outlet 28 is appropriately provided in the housing in the liquid ring portion of the pump. The outlet is spaced angularly from inlet 26 in the direction of rotation of the impeller, i.e. arrow "A".

In operation of the liquid ring portion of the pump, the impeller draws the inlet line vapor into pump inlet 26, rotates it around chamber 22 and forces it out outlet 28. The liquid ring pump continues to perform this process until fuel is drawn into inlet 26 at which time the liquid ring pump becomes flooded and its function of priming the fuel system pumping elements is complete It can be seen at the top of FIG. 1 that the radius of chamber 22 increases in the direction of arrow "A" from inlet 26. This increase in the volume of the chamber results in a decrease in pressure which effectively draws the vapor or liquid into the chamber. Likewise, it can be seen that the chamber decreases in volume toward outlet 28, resulting in an increase in pressure, to force the liquid out of the chamber through outlet 28.

The regenerative portion of the pump (i.e. the lower half of the illustrations in the drawings) includes an inlet 32 and an outlet 34 appropriately through housing 20 as indicated by the dotted lines 32,34 in FIG. 1. Again, the outlet is spaced angularly from the inlet in the direction of rotation of the impeller means, as indicated by arrow "A". As shown, generally, inlet 32 and outlet 34 are located at opposite ends of housing chamber 24.

As seen in FIG. 2, housing chamber 24 is located to one side of the impeller and extends around the radially outward periphery of the impeller blades 14, although the chamber 24 need not necessarily extend radially outwardly of the impeller blades. Therefore, the blades of the impeller fill only a portion of the overall chamber means defined by the spacing between the impeller blades and housing chamber 24. As the impeller blades "push" the fluid in a counterclockwise direction as viewed in FIG. 1 (i.e. arrow "A"), the blades moving through the liquid create a generally circular motion in the fluid as indicated by arrows "B" in FIG. 2. It is theorized that this combined motion results in creating a helical spiral action in the fluid, as indicated by arrow "C" (FIG. 1) from inlet port 32 toward outlet port 34. The result of the work done by the impeller on the fluid is a transmittal of energy from the impeller to the fluid which is physically evidenced by an increase in fluid pressure.

As stated, liquid from the liquid ring portion of the pump is fed to the inlet port 32 of the regenerative portion of the pump. This is shown by conduit line 36 in FIG. 1. Of course, the conduit line represents appropriate ducting in housing 20 From the foregoing, it can be seen that the pump of this invention can replace two separate pumps, i.e. a liquid ring pump and a regenerative pump, in a fuel pump system to both prime an engine's inlet line during engine start, as well as to generate the required pressure rise for engine start. This is accomplished with a unitary housing structure and only a single impeller, as described above. Considerable space and weight savings are afforded, which is critical in such applications as aerospace applications.

FIG. 2 best illustrates the "dual" concepts of the invention wherein the above-described structure is readily adaptable to double the capacity of the pump or to maintain a given capacity but considerably reduce the size of the pump components, yet a unitary housing and single impeller member still are used.

More particularly, referring to FIG. 2, and centerline 18, the illustrated structure shows two liquid ring pumps in the upper half of the illustration, one on each opposite side of line 18, and two regenerative portions of the pump in the lower half of the illustration on opposite sides of line 18. For brevity purposes, suffice it to say that the construction and operation of the pair of liquid ring pump portions and the pair of regenerative pump portions of the pump are identical to the description of the structure and functions described above for a single side of the pump. However, in order to explain the fluid and liquid flow schematics of the dual pump shown in FIG. 2, one of the liquid ring pump chambers is identified as **22*a* and one of the regenerative pump chambers is identified as 24*a*. Appropriate seal means, as at 39 are provided between the two "sides" of the pump. So as not to unnecessarily clutter the illustration with ducting through housing 20**, the conduit means between the various chambers of the dual pump are shown by schematic circulation lines.

Specifically, a common line 40 would be connected to the fuel system inlet line and then is split, as at 42, and is fed to the respective inlets (26) of the two liquid ring portions of the pump, as at 44. Both sides of the pump operate as described above in relation to FIG. 1, and the liquid from both liquid ring pump portions are fed through lines 46 and 46*a* to a common line 48 where the liquid enters the inlet port (32) of chamber 24*a* which is the chamber means for the right-hand regenerative pump portion of the pair of regenerative pump portions at the bottom of FIG. 2. The liquid is caused to increase in pressure in that regenerative pump portion and flows through its outlet (34), through line 50 to the inlet (32) of the left-hand regenerative pump portion of the dual pump. The liquid is caused to increase in pressure further and is fed from the outlet (34) of the second or left-hand regenerative pump portion for appropriate use, as to the main engine fuel pump through line 52. It is possible to criss-cross the chambers from that shown in FIG. 2 and likewise rearrange the conduit means. In other words, the locations of the liquid ring pump portions (or the regenerative pump portions) could be disposed in the housing, rather than across from each other as shown, or both could be on one side of line 40, as long as the conduit means are appropriately located in the housing and properly connecting the respective chambers. All of the advantages of using a single impeller would be present.

With a dual pump configuration as shown in FIG. 2, the size of the impeller means and any related components of the pump can be reduced. With any regenerative impel type pump, the pressure generated is proportional to the distance around the annulus of the pump. By using the illustrated dual pump and recirculating the liquid, the pressure simply is driven up on one side, fed to the other side and driven up further, all with the same impeller. Although these significant advantages are afforded primarily in the regenerative portion of the pump, the dual pump configuration also reduces the time for the priming ring pump function of the pump system.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A pump, comprising:

housing means defining first chamber means and second chamber means independent of the first chamber means;

impeller means rotatably mounted in the housing means and including at least one impeller blade successively movable through the first chamber means for cooperation therewith to provide a liquid ring portion of the pump and the second chamber means for cooperation therewith to provide a boosting portion of the pump;

inlet means for admitting a fluid to the first chamber means;

first outlet means for passing fluid from the first chamber means and feeding the fluid to the second chamber means for pressurizing therein; and second outlet means from the second chamber means from which pressurized fluid can be fed for appropriate use.

2. The pump of claim 1 wherein said impeller means include a central hub mounting the impeller blade, said inlet means being located through the housing near the hub.

3. The pump of claim 2 wherein said first outlet means is located through the housing angularly spaced from the inlet means.

4. The pump of claim 2, including gas outlet means from the first chamber means and located near the hub.

5. The pump of claim 4 wherein said gas outlet means is located spaced from the inlet means in the direction of rotation of the impeller means.

6. The pump of claim 1 wherein said first chamber means is located within a given portion of the housing means relative to rotation of the impeller means, and said second chamber means is located diametrically opposite the first chamber means.

7. The pump of claim 1 wherein said impeller blade defines a plane of rotation, and the second chamber means is located, at least in part, to one side of the impeller blade.

8. The pump of claim 7 wherein said second chamber means extends around said one side beyond the radial periphery of the impeller blade.

9. The pump of claim 1 wherein said first chamber means is located radially beyond the periphery of the impeller blade.

10. The pump of claim 1, including a pair of said first chamber means separated from each other on opposite sides of the impeller means, each having outlet means communicating with said second chamber means.

11. The pump of claim 10, including a pair of said second chamber means on opposite sides of the impeller means, with the outlet means of said pair of first chamber means communicating with one of the pair of second chamber means, and an outlet of said one of the pair of second chamber means communicating with an inlet to the other of the pair of second chamber means.

12. A pump, comprising:

impeller means;

a housing rotatably mounting the impeller means and defining a first chamber located radially outwardly beyond the periphery of the impeller blade and cooperating therewith to provide a liquid ring portion of the pump, and a second chamber located, at least in part, to one side of the impeller blade for cooperation therewith to provide a boosting portion of the pump;

inlet means for admitting a fluid to the first chamber means;

first outlet means for passing fluid from the first chamber means and feeding the fluid to the second chamber means for pressurizing therein; and second outlet means from the second chamber means from which pressurized fluid can be fed for appropriate use.

13. The pump of claim 12 wherein said impeller means include a central hub mounting the impeller blade, said inlet means being located through the housing near the hub.

14. The pump of claim 13 wherein said first outlet means is located through the housing angularly spaced from the inlet means.

15. The pump of claim 13, including gas outlet means from the first chamber means and located near the hub.

16. The pump of claim 15 wherein said gas outlet means is located spaced from the inlet means in the direction of rotation of the impeller means.

17. The pump of claim 12 wherein said first chamber means is located within a given portion of the housing means relative to rotation of the impeller means, and said second chamber means is located diametrically opposite the first chamber means.

18. The pump of claim 12 wherein said second chamber means extends around said one side beyond the radial periphery of the impeller blade.

19. A pump, comprising:

impeller means including at least one impeller blade;

housing means defining a pair of first chamber means separated from each other on opposite sides of the impeller means and cooperating with the impeller blade to provide a pair of independent liquid ring portions of the pump, and a pair of second chamber means on opposite sides of the impeller means for cooperating with the impeller blade to provide a pair of independent boosting portions of the pump, the impeller blade being successively movable through the first chamber means and then through the second chamber means;

inlet means for admitting a fluid to the pair of first chamber means;

first outlet means for passing fluid from at least one of the pair of first chamber means and feeding the fluid to one of the pair of second chamber means;

second outlet means from said one of the pair of second chamber means communicating with an inlet to the other of the pair of second chamber means; and third outlet means from said other of the pair of second chamber means from which pressurized fluid can be fed for appropriate use.

20. The pump of claim 19 wherein said pair of first chamber means is located within a given portion of the housing means relative to rotation of the impeller means, and said pair of second chamber means is located diametrically opposite the pair of first chamber means.

21. The pump of claim 19 wherein each of said impeller blade defines a plane of rotation, and the pair of second chamber means is located, at least in part, to one side of the impeller blade.

22. The pump of claim 21 wherein each of said pair of second chamber means extend around said one side beyond the radial periphery of the impeller blade.

23. The pump of claim 19 wherein each of said pair of first chamber means is located radially beyond the periphery of the impeller blade.

* * * * *